United States Patent [19]

Cambiuzzi et al.

[11] 4,110,949

[45] Sep. 5, 1978

[54] BUILDING BLOCK

[75] Inventors: Giulio Cambiuzzi, Imola (Bologna); Michele Montanelli, Stabbia (Florence), both of Italy

[73] Assignee: Baupres AG, Eschen, Liechtenstein

[21] Appl. No.: 810,829

[22] Filed: Jun. 28, 1977

[30] Foreign Application Priority Data

Jul. 5, 1976 [CH] Switzerland ..... 8565/76
Feb. 24, 1977 [CH] Switzerland ..... 2295/77

[51] Int. Cl.[2] ..... E04B 2/48

[52] U.S. Cl. ..... 52/437; 52/585; 52/605; 52/606

[58] Field of Search ..... 52/436, 442, 503–505, 52/585, 602, 603, 605, 606, 607, 284

[56] References Cited

U.S. PATENT DOCUMENTS 1,623,094 4/1927 Cooley et al. ..... 52/605
3,479,782 11/1969 Muse ..... 52/605

FOREIGN PATENT DOCUMENTS 647,249 7/1928 France ..... 52/585
117,260 1/1919 United Kingdom ..... 52/585
1,045,289 10/1966 United Kingdom ..... 52/437

*Primary Examiner*—James L. Ridgill, Jr.
*Attorney, Agent, or Firm*—Sughrue, Rothwell, Mion, Zinn and Macpeak

[57] ABSTRACT

A construction block of generally rectangular form having parallel upper and lower faces between which extend, through the block, one or more wide apertures and a plurality of narrow holes; the end faces of the block have wide grooves which cooperate, in a wall structure constructed from a plurality of horizontal courses of such blocks, to provide chambers between adjacent blocks of a course, the wide apertures in the blocks of adjacent courses cooperating to form vertically extending channels, the narrow holes house locating pins for holding the blocks of adjacent courses together until they are joined by concrete cast into the said vertical channels; the said upper and lower parallel faces have central depressions which form, between adjacent courses of blocks, horizontal channels linking the vertical channels so that the concrete cast into the vertical channels can also flow into and fill the horizontal channels to form an interlinked network giving great strength to the wall.

5 Claims, 14 Drawing Figures

FIG. 3
FIG. 4
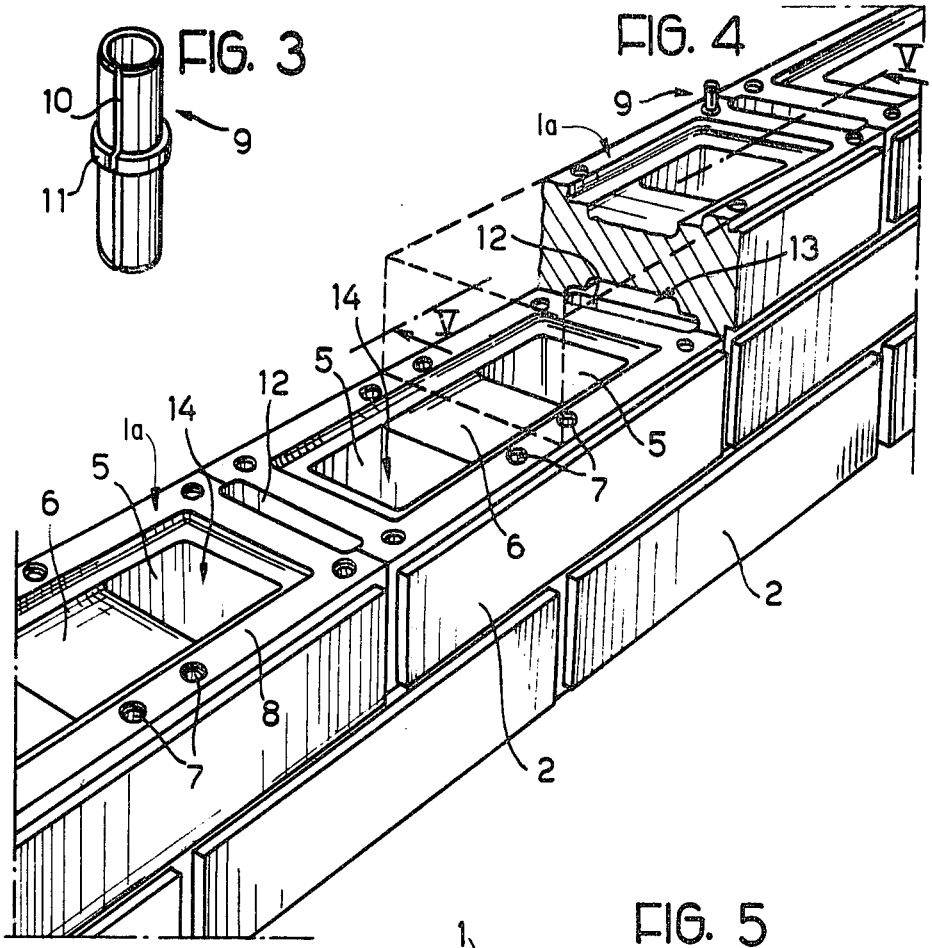
FIG. 5
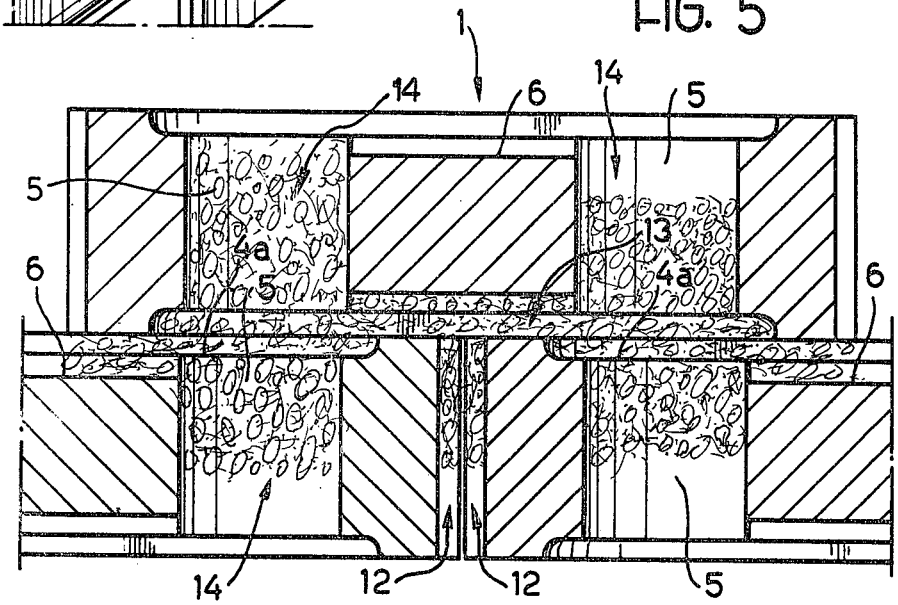

BUILDING BLOCK

The present invention relates to construction blocks. In particular the present invention relates to construction blocks having two substantially parallel generally planar faces, a plurality of holes, and at least one central aperture extending through the block from one of the said faces to the other, the said holes and the said aperture or apertures being disposed in such a way that at least some of them are aligned in successive courses of masonry constructed of a plurality of such blocks. This permits the engagement of block connector pins in the holes upon positioning of the blocks, and also the subsequent casting of concrete into the central apertures. Blocks formed as embodiments of the present invention are, moreover, provided with wide recesses in their end faces which are in the general form of grooves extending transverse the said two substantially parallel, generally planar faces.

The technical problem which the present invention seeks to solve is that of providing a building block of the above mentioned general type which is so formed that it can be used for the construction of masonry which is extremely resistant to externally applied forces, particularly forces transmitted during earth tremors or earthquakes, for use in seismic regions.

According to a first aspect the present invention provides a construction block having two generally planar substantially parallel faces, at least one aperature extending from one of the said substantially parallel faces to the other, and a plurality of holes also extending from one of the substantially parallel faces to the other and being substantially perpendicular thereto, at least the holes being located in positions such that they can be aligned with the holes of like such blocks in successive courses of a wall structure formed with a plurality of such blocks thus permitting the engagement of locating pins into at least some of the holes of the blocks during the positioning of the blocks, the apertures forming channels for receiving concrete cast into them after a plurality of such blocks have been assembled to form a wall structure, the said block being moreover provided with a wide recess in each of the end faces thereof, in which at least one of the two substantially parallel faces of the block has a central depression into the bottom of which opens the said aperature.

The presence of such central depressions permits concrete cast into the central apertures of a wall structure constructed with the use of such blocks to spread in a horizontal sense parallel to the courses into channels delimited by the above mentioned depressions of adjacent blocks superimposed in a staggered relation, also filling up the vertical channels defined by the above mentioned recesses in the ends of adjacent blocks, thus forming in the wall a reinforcing network of concrete which notably increases the strength of the wall.

Various embodiments of the invention will now be more particularly described, by way of example, with reference to the accompanying drawings, in which:

FIG. 3 is a perspective view of a connecting pin suitable for use with the embodiment of FIG. 1;

FIG. 4 is a perspective view, partially in section, of a section of masonry made with blocks of the type illustrated in FIG. 1;

FIG. 5 is a section taken on the line V—V of FIG. 4;

FIG. 5 is a plan view of a part of wall with air spaces, constructed from blocks such as that illustrated in FIG. 1;

Figure 1:
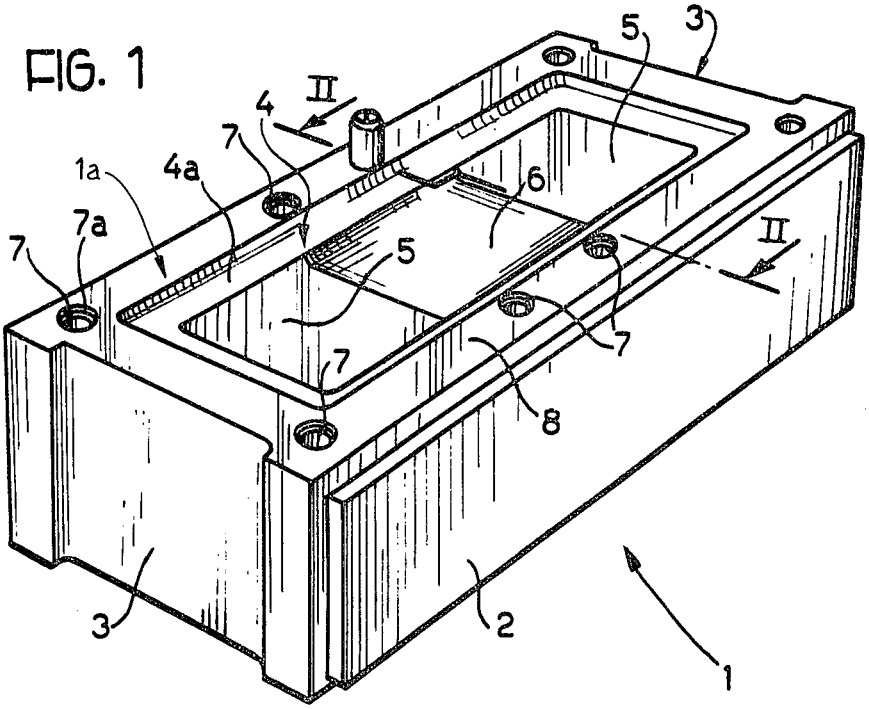
FIG. 1 is a perspective view of a construction block formed as a first embodiment of this invention.
Figure 2:
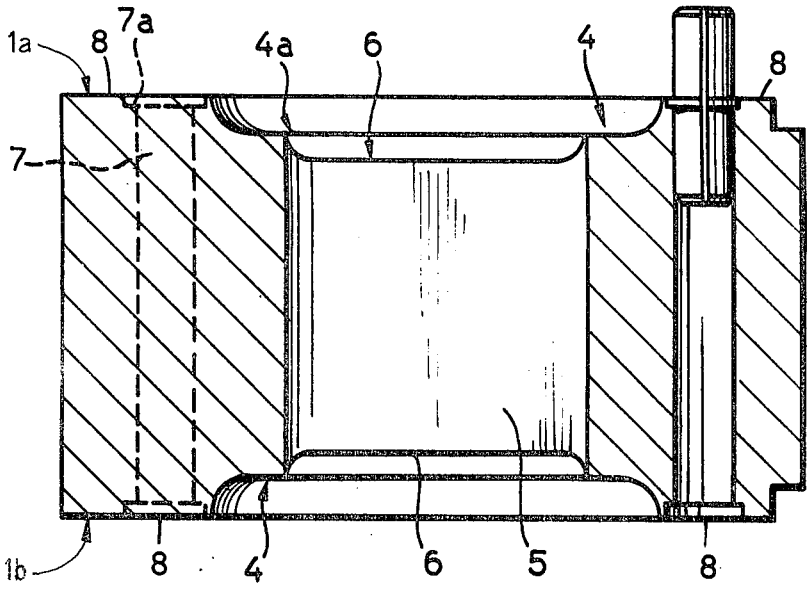
FIG. 2 is a section taken on the line II—II of FIG. 1.

Referring now to the drawings, and particularly to FIGS. 1 and 2 thereof, there is shown a parallelepiped block having plane parallel upper and lower faces 1*a*, 1*b* and one side face 2 which has a peripheral rebate extending all round it. When blocks such as the block 1 illustrated in FIG. 1 are used in a wall structure they are assembled together dry and in direct contact with one another and the side face 2 of each block is positioned on the exposed side of the wall to give the impression of mortar joints.

In each of the end faces of the block there is a wide shallow recess 3 which is open, in the form of a groove or channel at the edges which meet the upper and lower faces 1*a*, 1*b*. In the centre portion of the upper and lower faces 1*a*, 1*b* there are respective central depressions 4 each having a rectangular outline with the long sides extending parallel to the long sides of the respective upper and lower faces 1*a*, 1*b*. Two rectangular apertures 5 pass vertically right through the block 1 and open at each end into the bottoms of respective depressions 4. The apertures 5 are disposed symmetrically on either side of a transverse median plane of the block 1, and their axes lie in a longitudinal median plane of the block.

That part of the bottom of each depression 4 directly between the mouths of the apertures 5 is at a lower level than the remainder of the bottom of each depression 4 and is indicated with the reference numeral 6 whilst the remaining surface of the bottom of the depression 4, which extends around the periphery of the depression, is indicated with reference 4*a*.

The peripheral planar part of each of the upper and lower faces 1*a*, 1*b* of the block is indicated 8. Into these peripheral portions 8 of the upper and lower faces open several vertical through holes 7 which have at each end a portion 7*a* of greater diameter forming a recessed seat. The holes 7 serve for the engagement of locating pins (see FIG. 3) intended for the preliminary dry connection of the blocks as they are positioned in a wall. Each pin is in the form of a tube 9 provided with a longitudinal slit 10 which renders it resiliently expansible so that it can be a firm sliding fit in a hole 7. Midway along the length of each slit tube constituting a locating pin there is a circumferential annular ridge 11 which is intended to lodge in the recessed seat 7*a* of a hole 7.

For the construction of masonry using blocks 1 of the type described above in relation to FIGS. 1 to 3 the blocks are first assembled, dry, in successive courses, the blocks of one course being staggered or offset, as illustrated in FIGS. 4 and 5. The blocks are located in position with respect to the blocks of the adjacent courses by means of the locating pins or tubes 9 inserted into some or all of the peripheral holes 7.

As can be seen in FIGS. 4 and 5, in the wall structure thus obtained the vertical apertures 5 in the blocks 1 define continuous vertical channels 14 extending for the height of the wall structure, whilst the recesses 3 in the end faces of the blocks 1 define chambers 12 between laterally adjacent blocks 1, the chambers 12 extending only for the height of a single block, but each chamber 12 communicating at the top and bottom thereof with respective horizontal channels 13 which are defined between the depressions 4 in the upper and lower faces 1*a*, 1*b* of underlying and superimposed blocks 1 respectively. These horizontal channels 13 permit communication between the chambers 12, defined by the recesses 3 in the ends of laterally adjacent blocks 1, and the continuous vertical channels 14 formed by the aligned apertures 5 in the blocks 1.

After all of the courses (or only some in certain circumstances) have been laid, concrete is cast into the continuous vertical channels 14 and this also flows along the horizontal channels 13 into the chamber 12 to fill all the interspaces in the wall structure thus forming, after hardening, a reinforcing network which ensures a strong interconnection of the blocks 1 of the wall.

As a variation the bottom of each depression 4 could be constituted solely by the surface 6 between the apertures 5, that is the peripheral surface 4*a* would be flush with the surfaces 8 of the faces 1*a* and 1*b*; this would increase the strength of the block by increasing the cross-sectional area of the block.

Figure 6:
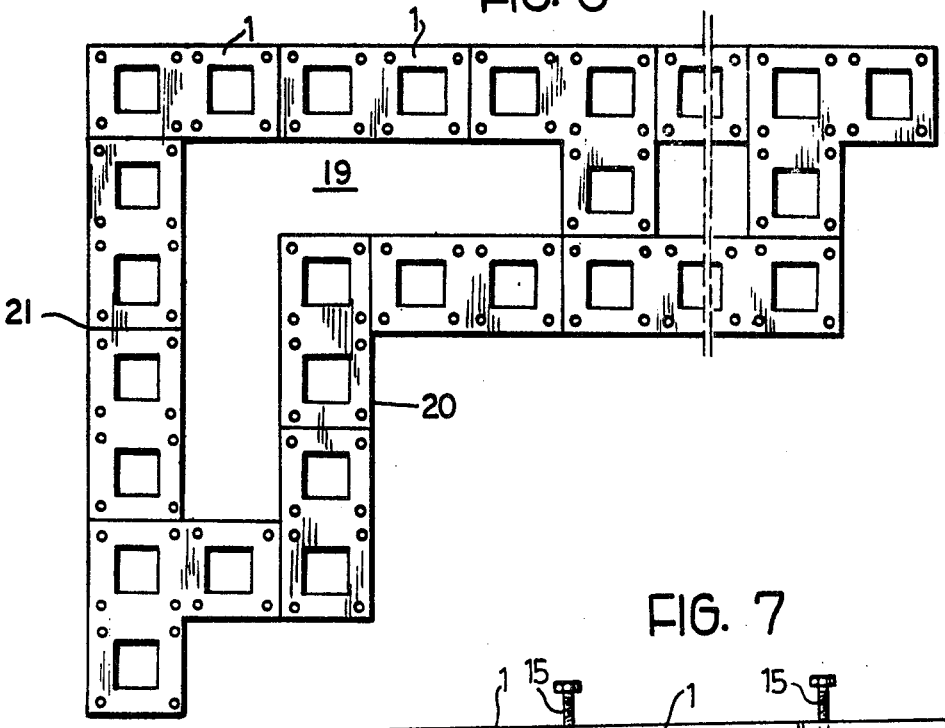

In FIG. 6 there is illustrated in plan a section of a wall, made with blocks of the type illustrated in FIG. 1 and provided with a cavity 19 between inner and outer layers 20 and 21, which cavity could be filled with thermal or acoustic insulating material.

Figure 7:
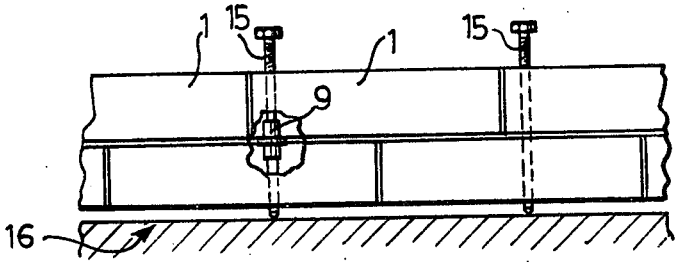
FIG. 7 illustrates an arrangement for levelling the initial courses of blocks.

In FIG. 7 there is shown a system for levelling the first two courses of blocks of the type illustrated in FIG. 1. This involves the use of levelling screws 15 introduced into the aligned holes 7 of the first two courses of masonry, the screws 15 being screwed down the internal surfaces of the tubes 9 which constitute the locating and connecting pins for the blocks, special internally threaded tubes being used for this purpose. The lower ends of the screws 15 react against the foundation 16 on which the blocks are laid. The screws 15 are adjusted and the level tested by known means, after which concrete is cast into the apertures 5 of the first two courses in such a way as to stabilise these two courses; after this concrete has hardened the screws 15 are extracted before continuing with the construction of the wall structure.

Figure 8:
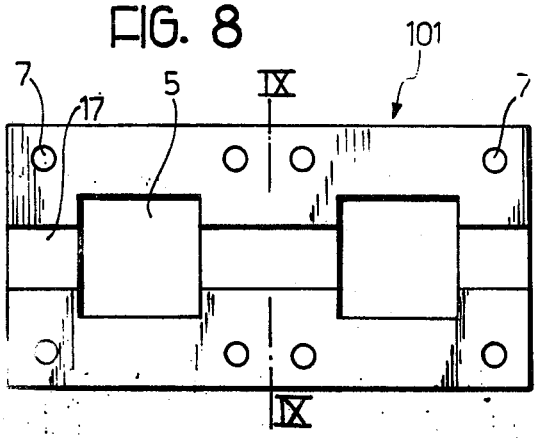
FIG. 8 is a plan view of a block formed as a second embodiment of the invention.
Figure 9:
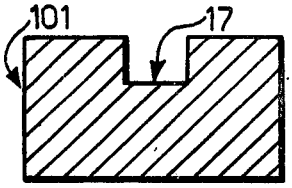
FIG. 9 is a section taken on the line IX—IX of FIG. 8.

The embodiment illustrated in FIGS. 8 and 9 comprises a block 101 which differs from that illustrated in FIG. 1 by the presence of a longitudinal channel 17 extending along the upper face parallel to the long sides thereof. This channel can be utilised either for the positioning of horizontal pipes and/or electrical cables, or for the possible positioning of reinforcing steel rods or bars intended to extend the whole length of the wall structure to provide a "hooping" effect, useful for constructions in seismic zones that is zones prone to earthquakes.

Figure 10:
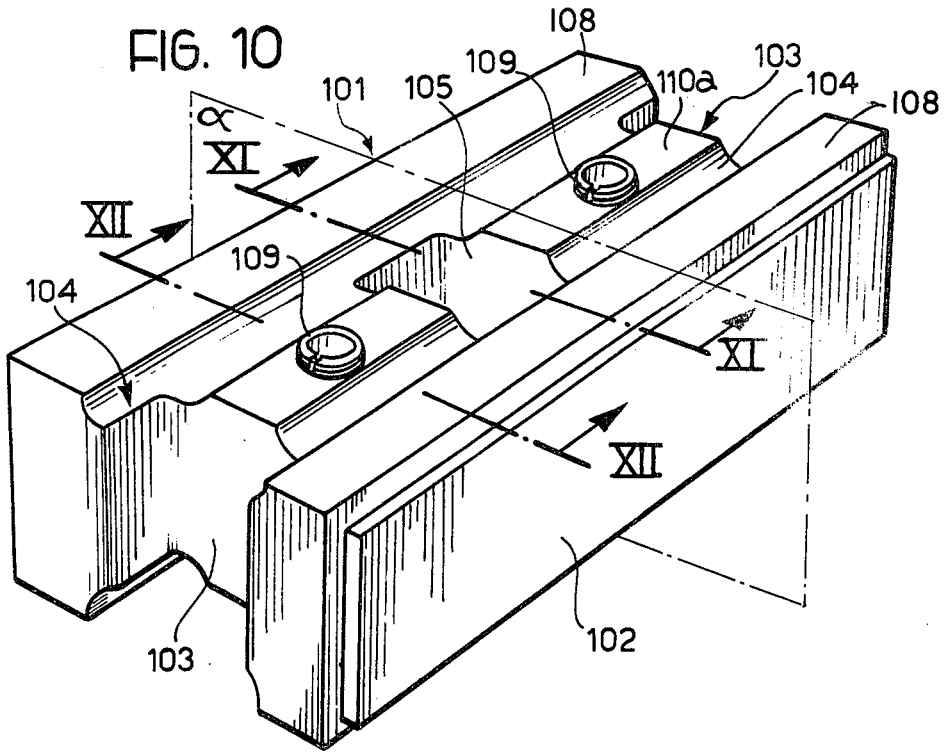
FIG. 10 is a perspective view of a block formed as a third embodiment of the invention.
Figure 11:
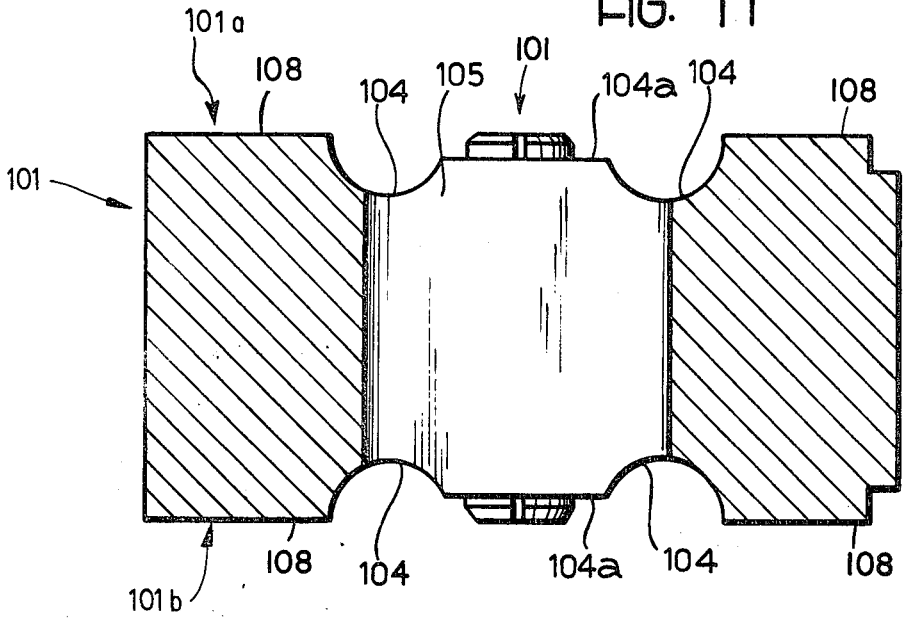
FIGS. 11 and 12 are two sections taken on the lines XI—XI and XII—XII respectively of FIG. 10.
Figure 12:
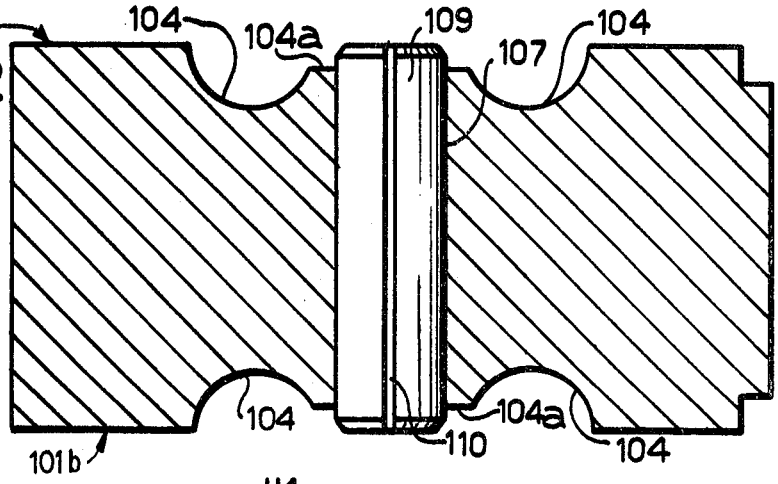

Referring now to FIGS. 10 to 12 there is shown a parallelepiped block, for example of brick, provided, like the embodiment of FIG. 1, with a side face 102 having a peripheral rebate for simulating mortar when the block is assembled with like such blocks to form a wall with the faces 102 all facing the same way.

The upper and lower faces of the block 101, indicated 101*a* and 101*b* respectively each have two peripheral planar portions 108 and a central depression, extending along the length of the face and constituted by two channel parts 104 having a substantially semi-circular cross-section, separated by a plane section 104*a*.

Passing through the block 101 from the upper to the lower face, and opening into the central depression of each of the upper and lower face 101*a*, 101*b* is an aperture 105 having a rectangular cross-section with walls parallel to the side faces of the block 107.

A median plane $\alpha$ of the block parallel to the end faces thereof constitutes a plane of symmetry for the aperture 105 inasmuch as it subdivides it into equal and symmetrical halves with respect to such plane.

In each of the end faces of the block 101 there is provided a deep and wide recess 103.

Each recess 103 has in transverse section, taken parallel to the upper face 101*a*, a shape identical with that of one of the two above mentioned halves of the central aperture 105.

Into the plane section 104 of the central depression open, on either side of the aperture 105, respective vertical cylindrical holes 107 which are symmetrically disposed with respect to the aperture 5. In each of the holes 107 there is lodged a tube 109, for example of plastics material, provided with a longitudinal slit 110. The length of the tube 109 is substantially the same as the height of the block 1, that is the separation of the upper and lower faces 101*a* and 101*b*, for which reason a short section of each end of the tube 109 projects from each of the plane section 104 flush with the upper and lower faces 101*a*, 101*b* as illustrated in FIGS. 10, 11, and 12.

Figure 13:
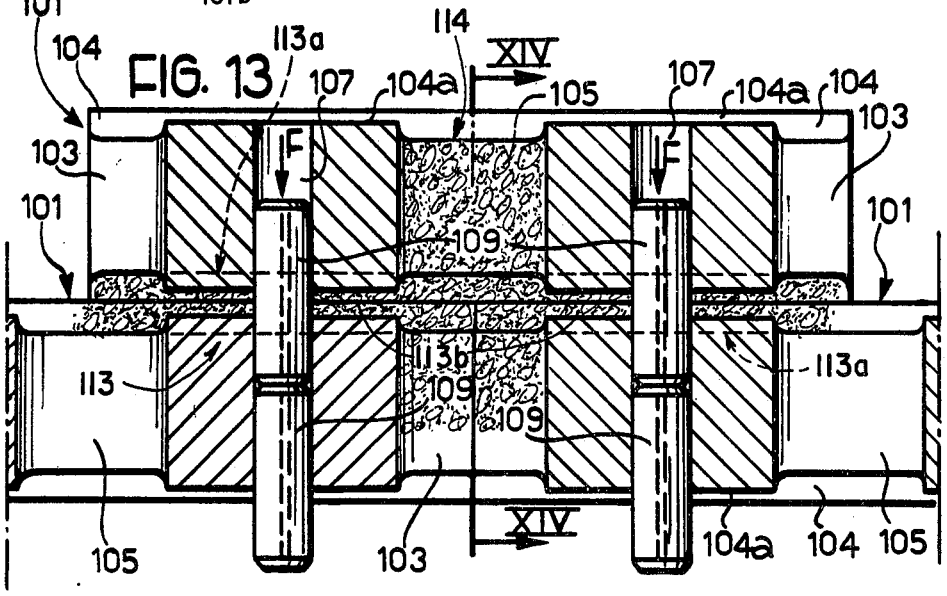
FIG. 13 illustrates, in vertical section, a part of a wall constructed with blocks of the type illustrated in FIG. 10.
Figure 14:
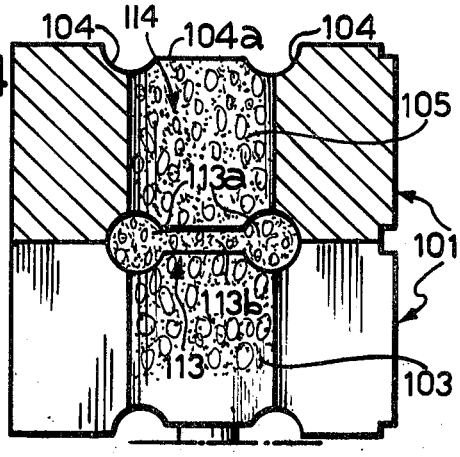
FIG. 14 is a section taken on the line XIV—XIV of FIG. 13.

In the construction of masonry the blocks 101 are assembled dry in staggered rows as illustrated in FIG. 13. When a block 101 has been positioned it is joined to the underlying blocks by displacing the tubes 109 using a tool which may be manually or mechanically operated. The tubes 9 are displaced axially, in the direction fo the arrow F of FIG. 13, along their respective holes 107 by a distance equal to approximately half the height of a block. Due to this displacement the tubes 109 are engaged halfway into the underlying block.

In a wall structure obtained with the use of such blocks the vertical aperture 105 of each block is aligned with a similar vertical aperture formed by the said two recesses 103 in the ends of two underlying (or overlying) blocks, which gives rise to the formation of continuous vertical channels 114 for the subsequent casting of concrete; moreover, the longitudinal depressions formed in the upper and lower faces of the blocks which are in contact with one another give rise to the formation of horizontal channels 113 with rectilinear axes, communicating with the above mentioned vertical channels.

Each horizontal channel 113 has, in cross section, a shape constituted by two generally circular end parts 113*a* connected by an intermediate part 113*b* of generally rectangular section. Concrete cast in the vertical channels 114 can thus extend with ease, and with little resistance into the horizontal channels 113, thereby giving rise, when hardened, to the formation of a reinforcing concrete network.

The generally cylindrical part 113*a* of the horizontal channels 113 may be used to provide housing for conduits intended to contain electrical conductors or else reinforcing steel in the case of a construction adapted for resisting earth tremors or earthquakes.

The advantages of this embodiment of the blocks of the present invention will be apparent from the preceding description, and can be summarized as follows.

A wall structure formed with such blocks permits the formation of a reinforcing network of concrete with vertically extending parts all of equal cross-section (the apertures 105 have, in fact, a cross section identical to that of the passages formed by two recesses 103 in adjacent end faces). The formation for the horizontal parts of such a reinforcing concrete network is ensured, even with the use of a dense concrete mixture, given the lower resistance to flow presented by the horizontal channels 113, and constitute efficient sealing against the ingress of atmospheric agents for any ducts or conduits embedded therein. Because the tubes 109 are originally mounted within each block the fabrication of a wall structure, is facilitated.

Blocks formed as embodiments of the present invention can be formed easily by pressing, and final trimming, such as by grinding of the faces, is quick and easy.

Finally, the shape of the horizontal channels 113 facilitates the insertion of conduits and/or conductors of electrical systems and permits the easy formation of structures for resisting earth tremors or earthquakes.

We claim:

1. A wall structure including:

a plurality of substantially similary blocks arranged in horizontal courses; the end faces of the blocks of each course being in contact with one another and being positioned above an intermediate point of the blocks of the subjacent course; each block having:

an upper face and a lower face having identical shape, said two faces being substantially paralled, said faces comprising longitudinal spaced apart planar side portions, the planar portions of each block being in contact with the planar portions of blocks of the adjacent courses, a central depression in each of said upper and lower faces extending longitudinally for the whole of the length of said block between two longitudinal planar side portions, each said block having a single central aperture having in a cross-section a shape which is symmetrical about a median plane of the block parallel to the end faces thereof, a recess in each of said end faces of said block having a shape, in a plan view, identical to that of one half the cross-sectional shape of said central aperture as divided by said median plane of symmetry, to define a chamber identical to said aperture when mated with a recess in an adjacent block, each central depression of each said block having, in cross-section, two longitudinal channel parts separated by an elevated central region having a plane upper face which is recessed with respect to the surface of said two planar portions of the associated one of said upper and lower faces of said block, holes in each said block opening into said central elevated region of said central depression of each of said upper and lower faces, and being symmetrically disposed with respect to said aperture in said block, locating pins housed in at least some of the holes and extending into the holes of adjacent blocks of adjacent courses, said depressions in each block defining between adjacent courses of blocks, horizontal channels which link said apertures and chambers, and a body of cast concrete filling said chambers, recesses and horizontal channels to provide an interconnected horizontal and vertical network of reinforcing concrete to hold said blocks together in said wall.

2. A wall structure as in claim 1, wherein said two channel parts of said central depression have a semi-circular cross-sectional shape.

3. A wall structure as in claim 1, wherein each said block has two said holes passing therethrough.

4. A wall structure as in claim 1, wherein said locating pins are constituted by cylindrical tubes having a longitudinal slit therein and having a length substantially equal to the distance between corresponding planar portions in the upper and lower faces of each said block.

5. In a construction block of the type having a substantially rectilinear configuration with the upper and lower surfaces having an identical configuration and the opposite end surfaces having an identical configuration, the improvement comprising a single substantially rectilinear aperture extending through said block from said upper surface to said lower surface and which is symmetrical about a median plane of said block parallel to an end surface of said block and a recess in each end face identical to one half of said aperture on one side of said median plane, said upper and lower surfaces having a pair of parallel spaced apart flat surfaces located on opposite sides of said aperture and recesses and a depressed portion extending parallel to said flat surfaces, said depressed portion being comprised of two spaced apart channels adjacent each flat surface and a raised central portion having a substantially flat upper surface and a pair of holes for receiving locating pins extending through said block intermediate each recess and said aperture and communicating with said raised central portion on said upper and lower surfaces. parallel to said flat surfaces, said depressed portion being comprised of two spaced apart channels adjacent each flat surface and a raised central portion having a substantially flat upper surface and a pair of holes for receiving locating pins extending through said block intermediate each recess and said aperture and communicating with said raised central portion on said upper and lower surfaces.

* * * * *